US011682358B2

(12) United States Patent
Lee et al.

(10) Patent No.: US 11,682,358 B2
(45) Date of Patent: Jun. 20, 2023

(54) ELECTRONIC APPARATUS AND CONTROL METHOD THEREOF

(71) Applicant: SAMSUNG ELECTRONICS CO., LTD., Suwon-si (KR)

(72) Inventors: Gyuheon Lee, Suwon-si (KR); Jihyeok Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 125 days.

(21) Appl. No.: 17/214,297

(22) Filed: Mar. 26, 2021

(65) Prior Publication Data

US 2021/0304693 A1 Sep. 30, 2021

Related U.S. Application Data

(60) Provisional application No. 63/000,062, filed on Mar. 26, 2020.

(30) Foreign Application Priority Data

Jun. 26, 2020 (KR) ..... 10-2020-0078546

(51) Int. Cl.
*G09G 3/34* (2006.01)
*G09G 3/36* (2006.01)

(52) U.S. Cl.
CPC ..... *G09G 3/3426* (2013.01); *G09G 3/3607* (2013.01); *G09G 2320/0233* (2013.01); *G09G 2320/062* (2013.01); *G09G 2360/16* (2013.01)

(58) Field of Classification Search
CPC ..... G09G 3/3426; G09G 3/3607; G09G 2320/0233; G09G 2320/062;
(Continued)

(56) References Cited

U.S. PATENT DOCUMENTS 8,427,419 B2 4/2013 Ahn et al.
8,531,387 B2 9/2013 Park et al.
(Continued)

FOREIGN PATENT DOCUMENTS

JP 2019-159252 A 9/2019
KR 10-2009-0044292 A 5/2009
(Continued)

OTHER PUBLICATIONS

KR20150072083A (English Translation)—specification only (Year: 2015).*
(Continued)

*Primary Examiner* — Antonio A Caschera
(74) *Attorney, Agent, or Firm* — Sughrue Mion, PLLC

(57) ABSTRACT

An electronic apparatus includes a memory configured to store first output luminance information corresponding to a first bit image, and second output luminance information corresponding to a second bit image; a display panel; a backlight including a plurality of backlight blocks configured to provide light to the display panel; a driver configured to individually drive each backlight block of the plurality of backlight blocks; and a processor configured to, based on receiving the first bit image, identify brightness information of the first bit image, and based on the brightness information being less than a threshold value, control the driver to drive at least one backlight block, from among the plurality of backlight blocks, based on the second output luminance information, wherein a number of bits of the second bit image is greater than a number of bits of the first bit image.

15 Claims, 14 Drawing Sheets

(58) Field of Classification Search
CPC ..... G09G 2360/16; G09G 2320/0626; G09G 2320/0633; G09G 2320/0646
See application file for complete search history.

(56) References Cited

U.S. PATENT DOCUMENTS

| | | | | |
|---|---|---|---|---|
| 16,360,847 | | 7/2019 | Lee et al. | |
| 11,132,959 | B2 | 9/2021 | Lee | |
| 2003/0164810 | A1* | 9/2003 | Kim | G09G 3/2003 348/E5.073 |
| 2009/0109165 | A1 | 4/2009 | Park et al. | |
| 2010/0315445 | A1 | 12/2010 | An et al. | |
| 2011/0050668 | A1 | 3/2011 | Park et al. | |
| 2011/0205256 | A1 | 8/2011 | Park et al. | |
| 2013/0194494 | A1 | 8/2013 | Chun et al. | |
| 2015/0062187 | A1 | 3/2015 | Park | |
| 2017/0011692 | A1 | 1/2017 | Lee et al. | |
| 2018/0182306 | A1 | 6/2018 | Seong et al. | |
| 2019/0289217 | A1 | 9/2019 | Nakagawa et al. | |
| 2021/0020114 | A1 | 1/2021 | Lee | |

FOREIGN PATENT DOCUMENTS

| | | | |
|---|---|---|---|
| KR | 10-0964466 | B1 | 6/2010 |
| KR | 10-1341020 | B1 | 12/2013 |
| KR | 10-2015-0072083 | A | 6/2015 |
| KR | 10-1644189 | B1 | 8/2016 |
| KR | 10-167514 | B1 | 11/2016 |
| KR | 10-2017-0006969 | A | 1/2017 |
| KR | 10-2019-0085324 | A | 7/2019 |
| KR | 10-2020-0022704 | A | 3/2020 |

OTHER PUBLICATIONS

International Search Report (PCT/ISA/210) dated Jul. 20, 2021 by the International Searching Authority in International Application No. PCT/KR2021/003669.

Written Opinion (PCT/ISA/237) dated Jul. 20, 2021 by the International Searching Authority in International Application No. PCT/KR2021/003669.

* cited by examiner

< APL : 4.3% >

< APL : 3.9% >

Case 2

ELECTRONIC APPARATUS AND CONTROL METHOD THEREOF

CROSS-REFERENCE TO RELATED APPLICATIONS

This application is based on and claims benefit of U.S. Provisional Application No. 63/000,062, filed on Mar. 26, 2020, and is also based on and claims priority under 35 U.S.C. § 119 to Korean Patent Application No. 10-2020-0078546, filed on Jun. 26, 2020, in the Korean Intellectual Property Office, the disclosures of which are incorporated by reference herein in their entireties.

BACKGROUND

1. Field

The disclosure relates to an electronic apparatus and a control method thereof. More particularly, the disclosure relates to a display device using a plurality of light sources and a control method thereof.

2. Description of Related Art

Development of electronic technology has led to the development and distribution of various types of electronic apparatuses. A mobile device which is used most widely these days and a display device such as a television (TV) have been rapidly developed in recent years.

A display device of the related art may output an image signal by implementing local dimming in order to improve a dynamic range and a contrast ratio. However, during the local dimming control, an output luminance difference may be greater in comparison with a difference in grayscales between regions in the image, and thus, there is a problem in that an image quality representation may be disadvantageous.

In particular, when a dark image is provided, there is a problem of providing a user with a screen including a distorted and exaggerated luminance difference.

SUMMARY

Provided are a display device capable of preventing a problem that a difference in brightness between regions is excessively highlighted during local dimming control and a control method thereof.

According to an aspect of the disclosure, there is provided an electronic apparatus including a memory configured to store first output luminance information corresponding to a first bit image, and second output luminance information corresponding to a second bit image; a display panel; a backlight including a plurality of backlight blocks configured to provide light to the display panel; a driver configured to individually drive each backlight block of the plurality of backlight blocks; and a processor configured to, based on receiving the first bit image, identify brightness information of the first bit image, and based on the brightness information being less than a threshold value, control the driver to drive at least one backlight block, from among the plurality of backlight blocks, based on the second output luminance information, wherein a number of bits of the second bit image is greater than a number of bits of the first bit image.

The first output luminance information may include first luminance information for each grayscale of the first bit image, the second output luminance information may include second luminance information for each grayscale of the second bit image, and the processor may be further configured to, based on the brightness information being less than the threshold value, control the driver to drive a first backlight block corresponding to pixels having a grayscale value less than a first threshold grayscale, from among a plurality of pixels included in the first bit image, based on the second output luminance information.

The processor may be further configured to control the driver to drive a second backlight block, from among the plurality of backlight blocks, corresponding to pixels having a grayscale value greater than or equal to the first threshold grayscale, from among the plurality of pixels included in the first bit image, based on the first output luminance information.

The memory may be further configured to store third output luminance information corresponding to a third bit image, the processor may be further configured to, based on the brightness information being less than the threshold value, control the driver to drive a second backlight block, from among the plurality of backlight blocks, corresponding to pixels having a grayscale value that is greater than or equal to the first threshold grayscale and less than a second threshold grayscale based on the first output luminance information, and control the driver to drive a third backlight block corresponding to pixels having a grayscale value greater than or equal to the second threshold grayscale based on the third output luminance information, and a number of bits of the third bit image is less than the number of bits of the first bit image.

The processor may be further configured to identify a plurality of regions of the first bit image corresponding to the plurality of backlight blocks, and based on an average grayscale value of each of the plurality of regions, identify the first backlight block corresponding to pixels having a grayscale value less than the first threshold grayscale, and control the driver to drive the first backlight block based on the second output luminance information.

The processor may be further configured to control the driver to drive at least a second backlight block adjacent to the first backlight block based on the second output luminance information.

The processor may be further configured to obtain the brightness information based on at least one of an average picture level (APL) of the first bit image, or a grayscale histogram of the first bit image.

The processor may be further configured to identify whether the brightness information is less than the threshold value by applying different weights to the APL and the grayscale histogram of the first bit image.

The first bit image may be a 10-bit image, the first output luminance information may correspond to 1024 grayscale levels, the second bit image may be an 11-bit image, and the second output luminance information may correspond to 2048 grayscale levels.

According to an aspect of the disclose, there is provided a method of controlling an electronic apparatus storing first output luminance information corresponding to a first bit image and second output luminance information corresponding to a second bit image, the method including: based on receiving the first bit image, identifying brightness information of the first bit image; and based on the brightness information being less than a threshold value, controlling at least one backlight block, from among a plurality of backlight blocks included in a backlight configured to provide light to a display panel, based on the second output luminance information, wherein a number of bits of the second bit image is greater than a number of bits of the first bit image.

The first output luminance information may include first luminance information for each grayscale of the first bit image, the second output luminance information may include second luminance information for each grayscale of the second bit image, and the controlling may include, based on the brightness information being less than the threshold value, driving a first backlight block corresponding to pixels having a grayscale value less than a first threshold grayscale, from among a plurality of pixels included in the first bit image, based on the second output luminance information.

The controlling may include driving a second backlight block, from among the plurality of backlight blocks, corresponding to pixels having a grayscale value greater than or equal to the first threshold grayscale, from among the plurality of pixels included in the first bit image, based on the first output luminance information.

The electronic apparatus may further include third output luminance information corresponding to a third bit image, wherein the controlling may include: based on the brightness information being less than the threshold value, driving a second backlight block, from among the plurality of backlight blocks, corresponding to pixels having a grayscale value that is greater than or equal to the first threshold grayscale and less than a second threshold grayscale based on the first output luminance information; and driving a third backlight block corresponding to pixels having a grayscale value greater than or equal to the second threshold grayscale based on the third output luminance information, and wherein a number of bits of the third bit image is less that the number of bits of the first bit image.

The controlling may include: identifying a plurality of regions of the first bit image corresponding to the plurality of backlight blocks; based on an average grayscale value of each of the plurality of regions, identifying the first backlight block corresponding to pixels having a grayscale value less than the first threshold grayscale; and driving the first backlight block based on the second output luminance information.

The controlling may include driving at least a second backlight block adjacent to the first backlight block based on the second output luminance information.

The identifying may include obtaining the brightness information based on at least one of an average picture level (APL) of the first bit image, or a grayscale histogram of the first bit image.

The identifying may include identifying whether the brightness information is less than the threshold value by applying different weights to the APL and the grayscale histogram of the first bit image.

The first bit image may be a 10-bit image, the first output luminance information may correspond to 1024 grayscale levels, the second bit image may be an 11-bit image, and the second output luminance information may correspond to 2048 grayscale levels.

According to an aspect of the disclosure, there is provided a non-transitory computer-readable medium storing instructions, the instructions including: one or more instructions that, when executed by one or more processors of an electronic apparatus storing first output luminance information corresponding to a first bit image and second output luminance information corresponding to a second bit image, cause the one or more processors to: based on receiving the first bit image, identify brightness information of the first bit image; and based on the brightness information being less than a threshold value, controlling at least one backlight block, from among a plurality of backlight blocks included in a backlight configured to provide light to a display panel, based the second output luminance information, wherein a number of bits of the second bit image is greater than a number of bits of the first bit image.

As described above, according to various embodiments, local dimming may be effectively implemented in displaying an image using a plurality of light sources.

According to various embodiments, when a somewhat dark image is provided, an image in which a problem of excessively emphasizing a difference of brightness and luminance between regions is overcome may be provided to a user.

According to various embodiments, luminance of a dark image may be represented more efficiently and correctly and provided to a user.

BRIEF DESCRIPTION OF THE DRAWINGS

The above and/or other aspects, features, and advantages of certain embodiments of the present disclosure will be more apparent from the following description taken in conjunction with the accompanying drawings, in which.

DETAILED DESCRIPTION

The disclosure will be described in greater detail below with reference to the accompanying drawings.

The terms used in the present disclosure and the claims are general terms identified in consideration of the functions of the various example embodiments of the disclosure. However, these terms may vary depending on intention, technical interpretation, emergence of new technologies, and the like, of those skilled in the related art. Unless there is a specific definition of a term, the term may be understood based on the overall contents and technological understanding of those skilled in the related art.

In this disclosure, the expressions "have," "may have," "include," or "may include," or the like, represent presence of a corresponding feature (e.g., components such as numbers, functions, operations, or parts) and does not exclude the presence of additional features.

The expression "at least one of A and B" should be understood to represent "A", "B," or both "A" and "B."

As used herein, the terms "first," "second," or the like, may denote various components, regardless of order and/or importance, and may be used to distinguish one component from another, and does not limit the components.

In addition, the description in the disclosure that one element (e.g., a first element) is "(operatively or communicatively) coupled with/to" or "connected to" another element (e.g., a second element) should be interpreted to include both the case that the one element is directly coupled to the another element, and the case that the one element is coupled to the another element through still another intervening element (e.g., a third element).

A singular expression includes a plural expression, unless otherwise specified. It is to be understood that the terms such as "comprise" or "comprising" are used herein to designate a presence of a characteristic, number, step, operation, element, component, or a combination thereof, and not to preclude a presence or a possibility of adding one or more of other characteristics, numbers, steps, operations, elements, components, or a combination thereof.

The terms such as "module," "unit," "part," or the like, may be used to refer to an element that performs at least one function or operation, and the element may be implemented as hardware or software, or a combination of hardware and software. Further, each of a plurality of "modules," "units," "parts," and the like, implemented in individual hardware, or the components may be integrated in at least one module or chip and be implemented in at least one processor.

In this disclosure, a term "user" may refer to a person using an electronic apparatus or an apparatus (e.g., an artificial intelligence (AI) electronic apparatus) that uses an electronic apparatus.

Hereinafter, various example embodiments of the disclosure will be described in greater detail with reference to the accompanying drawings.

Figure 1:
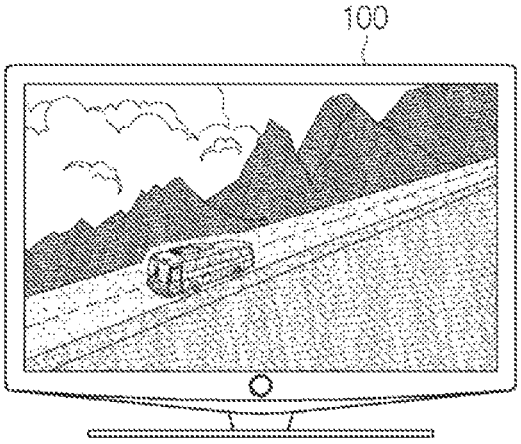
FIG. 1 is a diagram illustrating a feature of a display panel according to an embodiment.

FIG. 1 is a diagram illustrating a feature of a display panel according to an embodiment.

An electronic apparatus 100 according to an embodiment may display video data. The electronic apparatus 100 may be implemented as a television (TV), but is not limited thereto, and may be applicable to any device having a display function such as a video wall, a large format display (LFD), a digital signage, and a digital information display (DID), a projector display, or the like. In addition, the electronic apparatus 100 may be implemented as various types of displays, such as a liquid crystal display (LCD), an organic light-emitting diode (OLED) display, a liquid crystal on silicon (LCoS) display, a digital light processing (DLP) display, a quantum dot (QD) display, a quantum dot light-emitting diode (QLED) display, a micro light-emitting diode (pLED) display, a mini LED display, or the like. The electronic apparatus 100 may be implemented as a touch screen coupled with a touch sensor, a flexible display, a rollable display, a three-dimensional (3D) display, a display in which a plurality of display modules are physically connected, or the like.

In order for a display which is implemented as a non-self-luminous element such as, for example, an LCD panel, to implement an image, a backlight needs to be provided in a display module.

An LCD panel for implementing an image using a backlight may maintain an output image signal for a predetermined time to display an image. The backlight according to an embodiment may use backlight dimming. The backlight dimming may be divided into local dimming for dividing a screen into a plurality of regions and individually controlling the backlight lighting time for each region, and global dimming for collectively controlling the backlight lighting time of the entire screen.

The electronic apparatus 100 according to an embodiment may provide an image using local dimming. If the image provided by the electronic apparatus 100 through a screen is a somewhat dark image, when the image is displayed using local dimming in which the screen is divided into a plurality of regions and backlight lighting time is individually controlled by regions, there may be a problem in that the brightness difference between the plurality of regions may be somewhat distorted.

For example, there may be a problem that, even if a grayscale difference between a specific area and an adjacent area, among a plurality of regions divided in a somewhat dark image, is very low, an output luminance difference between the specific area and the adjacent area may be a high level. Various embodiments that may reduce the difference in output luminance will be described.

Figure 2:
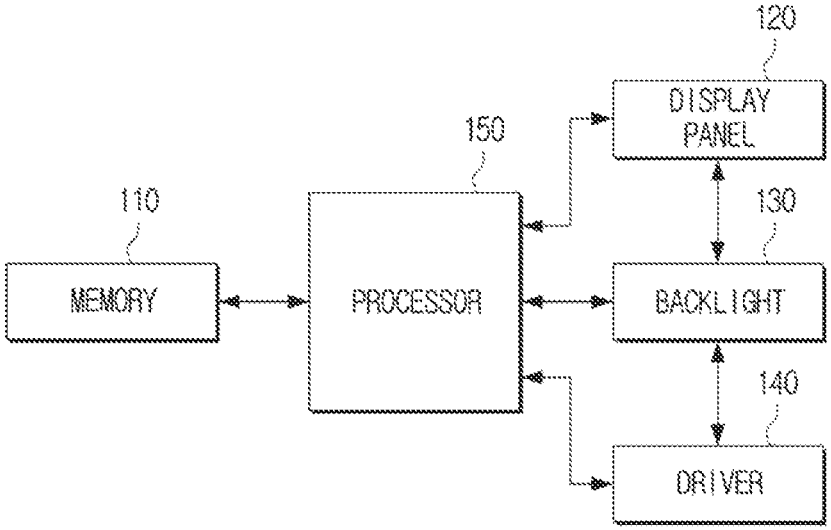
FIG. 2 is a block diagram illustrating a configuration of an electronic apparatus according to an embodiment.

FIG. 2 is a block diagram illustrating a configuration of an electronic apparatus according to an embodiment.

Referring to FIG. 2, the electronic apparatus 100 includes a memory 110, a display panel 120, a backlight 130, a driver 140, and a processor 150.

The memory 110 according to an embodiment may store various data such as an operating system (O/S) software module to drive the electronic apparatus 100, various multimedia contents, or the like.

The memory 110 may pre-store first output luminance information corresponding to a first bit image and the second output luminance information corresponding to a second bit image.

The first output luminance information may include luminance information for each grayscale of the first bit image, and the second output luminance information may include luminance information for each grayscale of the second bit image. The grayscale represents the brightness of each pixel included in the image by an integer. For example, the 8-bit image may be represented as zero to 255 grayscales, and the luminance information for each grayscale of the 8-bit image may include luminance information corresponding to each of the zero to 255 grayscales. The output luminance is proportional to an intensity of power applied to the backlight 130, the duty ratio, and the output luminance information may be referred to as a power curve, but it is commonly referred to as output luminance information for convenience.

As another example, a 10-bit image may be represented as a grayscale of 0 to 1023, and luminance information for each grayscale of a 10-bit image may include luminance information corresponding to each of 0 to 1023 grayscales. A specific number such as 8 bits and 10 bits is an example for convenience and is not limited thereto. For example, the electronic apparatus 100 may receive, store, or output various bit images. This will be described later with reference to FIGS. 6 and 7.

The integer corresponding to brightness by pixels may be represented as a grayscale value, a brightness value, a brightness code, or the like, but will be commonly referred to as a grayscale value for convenience.

The display panel 120 may include a plurality of pixels and may display an image. According to an embodiment, the display panel 120 may be implemented as a liquid crystal display panel. The liquid crystal panel is a display panel implemented as a liquid crystal device using a liquid crystal to electrically control transmittance of light.

According to an embodiment, the display panel 120 may be operated in such a manner that liquid crystal is injected between two glass plates, and the injected liquid crystals pass light supplied from the backlight 130 in a vertical orientation and a horizontal twist orientation through ON/OFF of the thin film transistor, and scan the light onto the front surface of the display panel 120.

Since the liquid crystal panel is implemented as a liquid crystal element that is not self-luminous, the electronic apparatus 100 includes the backlight 130 so that a liquid crystal panel implements an image. The backlight 130 may function to uniformly emit light so that the display image may be visible to the eyes.

The backlight 130 according to an embodiment may include a plurality of backlight blocks, a light guide plate, and an optical sheet. The backlight 130 may emit monochromatic light (light of a particular wavelength) when power is supplied. In particular, the backlight 130 according to an embodiment may emit white light.

Each of the plurality of backlight blocks included in the backlight 130 may include a light source, and the light source may be implemented as a blue LED for high color reproduction. The optical sheet may be implemented as a QD sheet. The QD sheet may generate various colors by changing the wavelength of light emitted from the plurality of light sources according to the size of the particles. For example, the optical sheet may convert a wavelength of a portion of blue (B) light emitted from a light source to generate red (R) light and green (G) light. The optical sheet may convert the wavelength of the light, and may be referred to as a wavelength conversion unit, but is commonly referred to as an optical sheet for convenience.

The display panel 120 may include a plurality of pixels, and may control the brightness of each of the plurality of pixels using the liquid crystal. For example, when the display panel 120 displays a relatively dark image based on the image signal, the display panel 120 may display an image of low luminance by blocking a number of lights supplied from the backlight 130 by the liquid crystal. As another example, when the display panel 120 displays a relatively bright image on the basis of the image signal, the display panel 120 may display an image of high luminance by passing a number of the light supplied from the backlight 130 by the liquid crystal.

Because the liquid crystal of the display panel 120 might not block all of the light emitted from the light source 121, the backlight 130 may implement local dimming by individually driving the plurality of light sources 121 under the control of the processor 150 in order to properly represent an image of low luminance, upscale the dynamic range, and improve contrast ratio.

The backlight 130 may be divided into a plurality of backlight blocks, and each of the plurality of backlight blocks may include at least one light source. Each of the plurality of backlight blocks may correspond to different regions of the display panel 120. A detailed description thereof will be made with reference to FIGS. 3 and 4.

According to an embodiment, the processor 150 may be implemented with a digital signal processor (DSP), a microprocessor, and a timing controller (TCON) which process a digital video signal, but this is not limited thereto. The processor 150 may include one or more among a central processing unit (CPU), a micro controller unit (MCU), a micro processing unit (MPU), a controller, an application processor (AP), a communication processor (CP), an advanced reduced instruction set computing (RISC) machine (ARM) processor, or may be defined as a corresponding term. The processor 150 may be implemented as a system on chip (SoC) type or a large scale integration (LSI) type in which a processing algorithm is built therein or in a field programmable gate array (FPGA) type.

The processor 150 may drive the backlight 130 to provide light to the display panel 120. The processor 150 may adjust at least one of the supply time and the intensity of the driving current (or driving voltage) supplied to the backlight 130 and output the same. The processor 150 may control the brightness of the light sources included in the backlight 130 by a pulse width modulation (PWM) signal having a variable duty ratio, or may vary the intensity of the current to control the brightness of the light sources of the backlight 130. The PWM signal may control light up and light down ratio of light sources and the duty ratio (%) may be determined according to the dimming value input from the processor 150.

The electronic apparatus 100 according to an embodiment may include a driver 140 (or a driver integrated circuit (IC)) for individually controlling each of a plurality of backlight blocks included in the backlight 130, and the processor 150 may be configured to control the display panel 120 and the backlight 130 through the driver 140. As another example, the processor 150 may be implemented in a form that includes a driver IC for driving the backlight 130. For example, the processor 150 may be implemented as a DSP, and may be implemented as a digital driver IC as a single chip. However, the driver IC may be implemented as hardware separate from the processor 150. For example, when the light sources included in the backlight 130 are implemented as LED elements, the driver IC may be implemented as at least one LED driver that controls the current applied to the LED elements. According to an embodiment, the LED driver may be disposed at a rear end of a power supply (e.g., a switching mode power supply (SMPS)) to receive a voltage from a power supply. However, according to another embodiment, a voltage may be applied from a separate power supply device. Alternatively, the SMPS and the LED driver may be implemented in an integrated module type.

Figure 3:
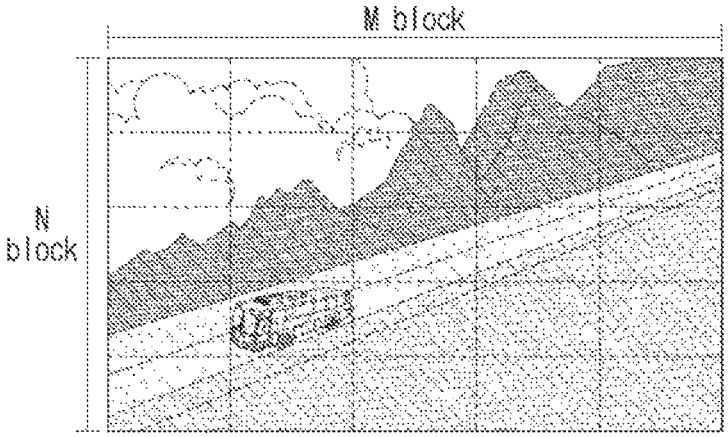
FIG. 3 is a diagram illustrating a plurality of light sources according to an embodiment.

FIG. 3 is a diagram illustrating a plurality of light sources according to an embodiment.

The processor 150 according to an embodiment may identify an input image as an image block of a specific size. For example, referring to FIG. 3, the processor 150 may identify the first bit image as a region corresponding to each of the plurality of backlight blocks.

Figure 4:
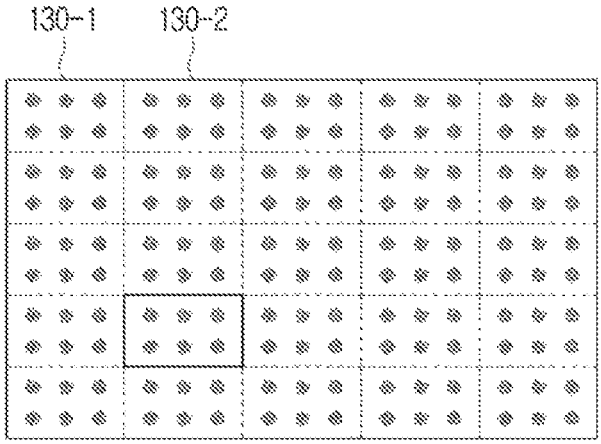
FIG. 4 is a diagram illustrating a local dimming method according to an embodiment.

FIG. 4 is a diagram illustrating a local dimming method according to an embodiment.

Referring to FIG. 4, the backlight 130 may be implemented as a direct type backlight unit. For example, the direct type backlight unit may have a structure in which a plurality of optical sheets and a diffusion plate are stacked on a lower portion of the display panel 120, and a plurality of light sources are disposed on a lower portion of the diffusion plate.

In the case of a direct type backlight unit, the backlight unit may be divided into a plurality of backlight blocks, as shown in FIG. 4. In this example, each of the plurality of backlight blocks may be driven according to a current duty (or a duty ratio) based on the image information of the corresponding screen area.

For example, the backlight 130 may be divided into a plurality of backlight blocks, and a first backlight block 130-1 among the plurality of backlight blocks may correspond to the first region (e.g., the uppermost left) of the display panel 120. The correspondence relationship may mean that the light emitted from the first light source included in the first backlight block is provided to the first region of the display panel 120.

As another example, a second backlight block 130-2, among a plurality of backlight blocks, may be in a correspondence relationship with the second region of the display panel 120. The light emitted by the second light source included in the second backlight block may be provided to the second region.

Returning to FIG. 2, when the first bit image is received, the processor 150 may identify brightness information of the received first bit image. If the identified brightness information is less than the threshold value, the processor 150 may control at least one backlight block of the plurality of backlight blocks included in the backlight 130 based on the second output luminance information. The brightness information of the first bit image may be an average picture level (APL) for each frame of an image. The detailed description thereof will be described with reference to FIG. 5.

Figure 5:
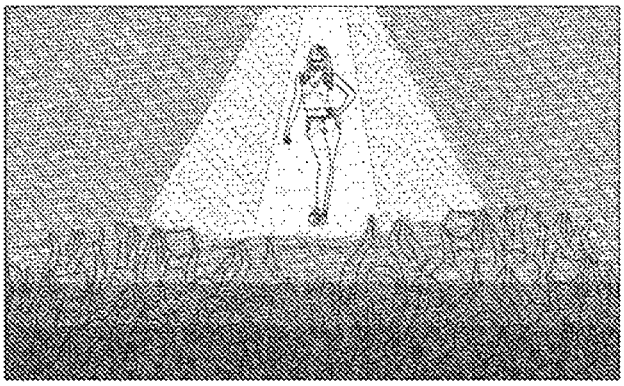
FIG. 5 is a diagram illustrating brightness information according to an embodiment.

FIG. 5 is a diagram illustrating brightness information according to an embodiment.

Referring to FIG. 5, the processor 150 may identify an APL for each frame of an image as brightness information of a corresponding image. For example, the brightness information of the image may be an average grayscale value for pixel data of one frame unit of the image. In this example, the image may be relatively brighter as APL increases, and the image may be relatively darker as the APL decreases.

However, the brightness information of the image may refer to various features related to the brightness of an image such as the maximum grayscale value, the lowest grayscale value, and the like, in the frame other than the APL. For example, the brightness information may refer to a grayscale histogram of an image. A detailed description thereof will be made with reference to FIG. 10.

The processor 150 according to an embodiment may identify whether the brightness information of the first bit image is less than a threshold value. The threshold value may be a value set to identify whether the corresponding image corresponds to a dark image. For example, the processor 150 may obtain a threshold value according to a value set by a manufacturer, a value set by the user, or a value identified based on the metadata of the image, and identify whether the brightness information of the first bit image is less than the threshold value.

For example, the processor 150 may obtain the average picture level of the first bit image as brightness information and identify whether the average picture level is less than 6%. Here, 6% is merely an example of a threshold value and is not limited thereto.

Referring to FIG. 5, the processor 150 may identify that the brightness information of the first bit image is less than a threshold value because the average picture level of the first bit image is 4.3%. The processor 150 may control at least one backlight block among the plurality of backlight blocks constituting the backlight 130 based on the second output luminance information instead of the first output luminance information corresponding to the first bit image. A detailed description of the first output luminance information and the second output luminance information will be described with reference to FIGS. 6 and 7.

Figure 6:
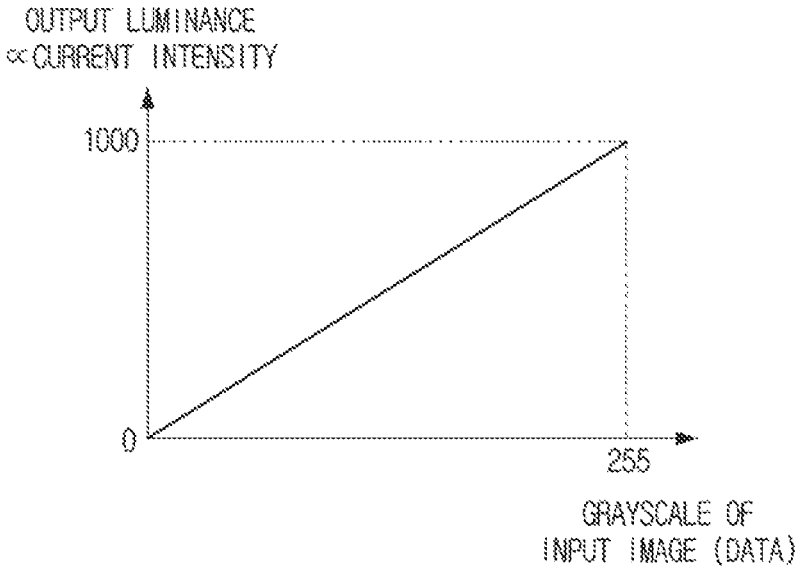
FIG. 6 is a diagram illustrating first output luminance information according to an embodiment.

FIG. 6 is a diagram illustrating first output luminance information according to an embodiment.

The electronic apparatus 100 may include first output luminance information. For example, the electronic apparatus 100 may store first output luminance information corresponding to the first bit image. The first bit image may refer to 8 bits, but this is not limited thereto. For example, the first bit image may be various bit images such as 10 bits. For convenience, the first bit image is assumed as an 8-bit image.

Referring to FIG. 6, an X-axis denotes a grayscale of an input image, and the Y-axis denotes an output luminance (Nits). For example, in the case of an 8-bit image, the grayscale may be represented as an integer of 0 to 255 grayscales, so that the graph shown in FIG. 6 may represent the output luminance corresponding to each of the 0 to 255 grayscales. Here, the output luminance may be proportional to the intensity of the current applied to the backlight 130.

The processor 150 may provide the first bit image based on the first output luminance information. For example, the processor 150 may output a grayscale value (or a grayscale, a brightness code, or the like) of 10 included in the first bit image to the output luminance 25 (nits) based on the graph shown in FIG. 6.

The electronic apparatus 100 may include second output luminance information corresponding to a second bit which is different from the first bit. This will be described with reference to FIG. 7.

Figure 7:
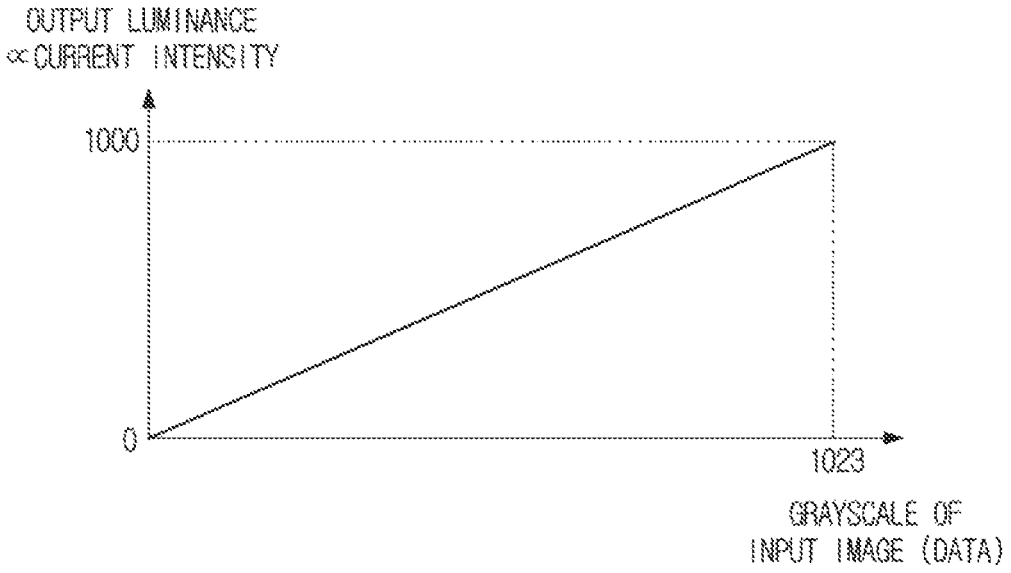
FIG. 7 is a diagram illustrating second output luminance information according to an embodiment.

FIG. 7 is a diagram illustrating second output luminance information according to an embodiment.

The electronic apparatus 100 may include second output luminance information. For example, the electronic apparatus 100 may store second output luminance information corresponding to the second bit image. The second bit image may refer to 10 bits, but this is not limited thereto. For example, the second bit image may refer to an image of a higher number of bits than the first bit image. For example, if the first bit image is an 8-bit image, then the second bit image may be an image having 10 bits, 11 bits, etc. For convenience, a second bit image is assumed as a 10-bit image.

The second output luminance information may include luminance information for each grayscale. Referring to FIG. 7, the X-axis denotes a grayscale of an input image, and the Y-axis denotes an output luminance. For example, in the case of a 10-bit image, the grayscale may be represented as an integer of 0 to 1023 grayscales, so that the graph shown in FIG. 7 may represent the output luminance corresponding to each of the 0 to 1023 grayscales. The output luminance may be proportional to the intensity of the current applied to the backlight 130.

The processor 150 may provide a second bit image based on the second output luminance information. For example, the processor 150 may output a grayscale value (or a grayscale, a brightness code, or the like) 1023 of a grayscale included in the second bit image to the output luminance 1000 based on the graph shown in FIG. 7.

If the brightness information of the first bit image is less than the threshold value, the processor 150 may control at least one backlight block of the plurality of backlight blocks based on the second output luminance information instead of the first output luminance information. The detailed description thereof will be described with reference to FIG. 8.

Figure 8:
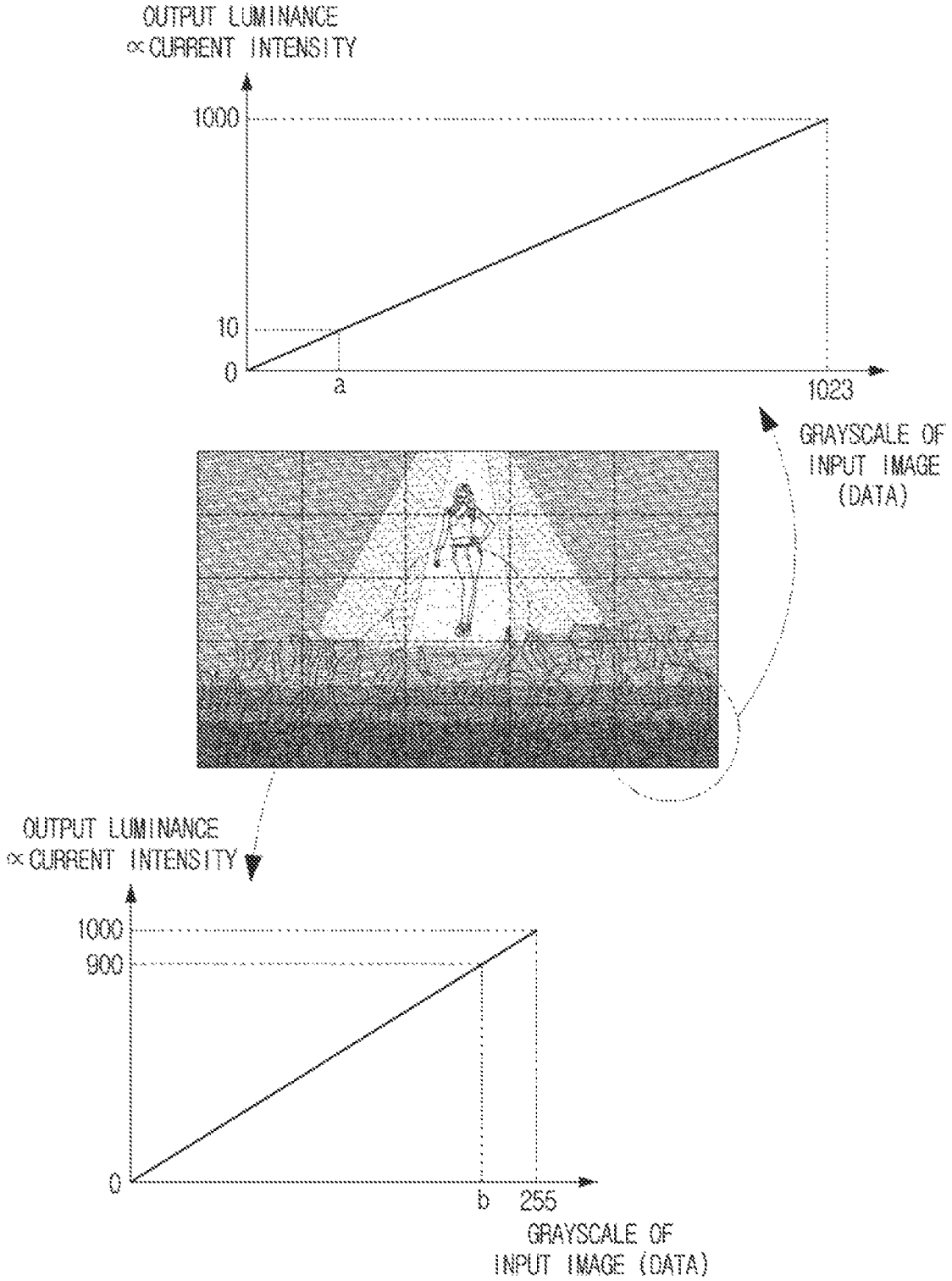
FIG. 8 is a diagram illustrating first and second luminance information according to an embodiment.

FIG. 8 is a diagram illustrating first and second luminance information according to an embodiment.

As shown in FIG. 8, the brightness information of the first bit image may be less than a threshold value. For example, if the average picture level APL of the first bit image is less than 6%, the backlight block corresponding to the pixels having a grayscale value less than the first threshold gray among the plurality of pixels included in the first bit image may be driven based on the second output luminance information.

For example, the image shown in FIG. 8 may be an 8-bit image, and the output luminance information corresponding to the 8-bit image may include output luminance corresponding to each of 0 to 255 grayscales. However, when the local dimming is applied on the 8-bit image on the basis of the first output luminance information, the luminance difference between the specific region and the adjacent region may be distorted, or the luminance difference may be greatly exaggerated. For example, an 8-bit image may be divided into a plurality of regions, and an output luminance difference between a specific region and an adjacent region may be greatly exaggerated even though a difference between a specific region of the plurality of regions and an adjacent region is not large. Referring to FIG. 6, it may be assumed that the grayscale of a specific region in the first bit image is 10, and the output luminance corresponding to the grayscale 10 is 39. If the grayscale of the region adjacent to the specific region is 20 and the output luminance corresponding to the grayscale 20 is 78, the grayscale difference is 10 and the output luminance difference is 39. If the brightness information of the first bit image is less than a threshold value, that is, if the first bit image is a somewhat dark image, the user may feel the output luminance difference 39 as a slightly greater brightness difference and that distortion has occurred in the image.

The processor 150 may drive a backlight block corresponding to pixels having a grayscale value less than a first threshold grayscale, among a plurality of pixels included in the first bit image, based on the second output luminance information if the brightness information of the first bit image is less than a threshold value.

Referring to FIG. 8, the grayscale of a specific region in the first bit image is 10 and the output luminance corresponding to the grayscale 10 according to the second output luminance information is 9.77. If the grayscale of the region adjacent to the specific region is 20 and the output luminance corresponding to the grayscale 20 is 19, the grayscale difference is 10 and the difference between the specific region and the adjacent region is about 9.8. The user may feel comfortable in watching the dark image, since the user may feel output luminance difference 9.8 as a somewhat smaller luminance difference.

The graphs illustrated in FIGS. 6 to 8 illustrate that the maximum output luminance of the electronic apparatus 100 is 1000 (Nits), and an increase in the output luminance according to the increase in the grayscale is linear, and the embodiment is not limited thereto.

For example, the maximum output luminance of the electronic apparatus 100 may vary depending on a manufacturing purpose of a manufacturer, the manufacturing specification, a setting value of the manufacturing process, or the like, and the increase in the output luminance according to the increase in the grayscale may be non-linear.

Referring to FIG. 8, the processor 150 may identify the first bit image as a region corresponding to each of the plurality of backlight blocks.

If the brightness information of the first bit image is less than the threshold value, the processor 150 may identify a backlight block corresponding to the pixels having a grayscale value less than the first threshold grayscale based on the average grayscale value of each of the identified regions, and drive the identified backlight block based on the second output luminance information. For example, the processor 150 may drive a region having an average grayscale value, among a plurality of regions included in the first bit image, to an output luminance of 10 nits based on the second output luminance information. The processor 150 may drive the region having the b grayscale value greater than or equal to the first threshold grayscale, among the plurality of regions, to the output luminance 900 nits based on the first output luminance information. The first threshold grayscale may be variously changed according to the user's setting value, the feature of the image, the setting value of the manufacturer, or the like.

Figure 9:
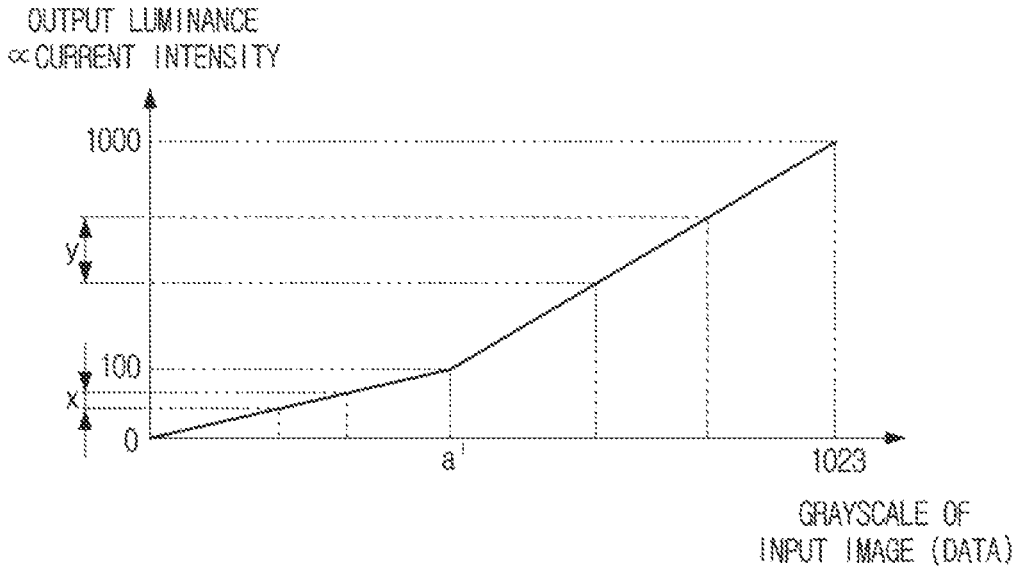
FIG. 9 is a diagram illustrating output luminance information corresponding to an image according to an embodiment.

The output luminance information applied to the first bit image as illustrated in FIG. 8 may be obtained combining the first output luminance value with the second output luminance value, and the detailed description will refer to FIG. 9.

FIG. 9 is a diagram illustrating output luminance information corresponding to an image according to an embodiment.

Referring to FIG. 9, if the first threshold grayscale is a', the processor 150 may drive a pixel or region having a grayscale value less than a' based on the second output luminance information corresponding to the second bit image. The processor 150 may drive the pixel or region having the grayscale value greater than or equal to a' based on the first output luminance information corresponding to the first bit image.

Referring to FIG. 9, when a change amount of the grayscale value is the same, an output luminance difference (x) based on the second output luminance information may be different from the output luminance difference (y) based on the first output luminance information. For example, the output luminance difference (x) based on the second output luminance information may have a relatively smaller change amount than the output luminance difference (y) based on the first output luminance information.

The grayscale value less than the first threshold grayscale (a') may refer to a somewhat dark pixel or region, and if the output luminance change amount according to a change amount of the grayscale value is reduced in the grayscale range less than the first threshold grayscale (a'), that is, 0 to a', the user may less feel that the brightness is distorted when watching a dark image.

Referring to FIG. 2, the processor 150 may obtain brightness information based on at least one of the APL of the first bit image or a grayscale histogram of the first bit image. A specific description of the grayscale histogram will be given with reference to FIG. 10.

Figure 10:
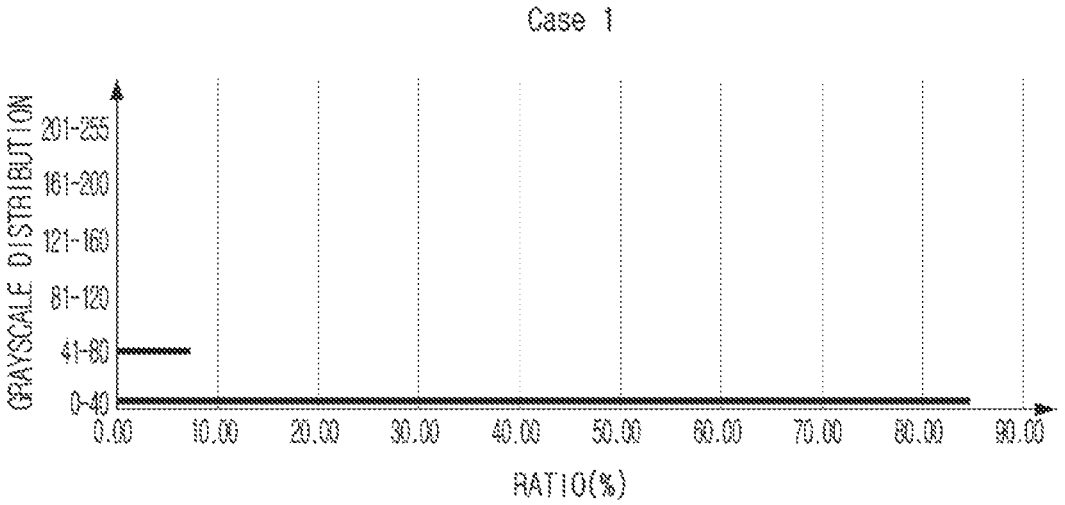
FIG. 10 is a diagram illustrating a grayscale histogram according to an embodiment.

FIG. 10 is a diagram illustrating a grayscale histogram according to an embodiment.

The grayscale histogram illustrated in FIG. 10 represents the grayscale distribution of a plurality of grayscales included in the first bit image illustrated in FIG. 8.

For example, the pixels belonging to the grayscale 0 to 40 among the total pixels included in the first bit image may occupy 85%, and the pixels belonging to the grayscales 41 to 80 may occupy 10%. It may be assumed that the pixel belonging to the grayscale 121 or higher is 0%. The processor 150 may identify that the brightness information of the first bit image is less than a threshold value. For example, the processor 150 may identify that the brightness information of the first bit image is less than a threshold value when a grayscale greater than or equal to a threshold grayscale among the entire pixels included in the first bit image is 0%. The threshold grayscale may be variously changed according to the user's setting, the setting of the manufacturer, the brightness feature of the first bit image, or the like.

Figure 11:
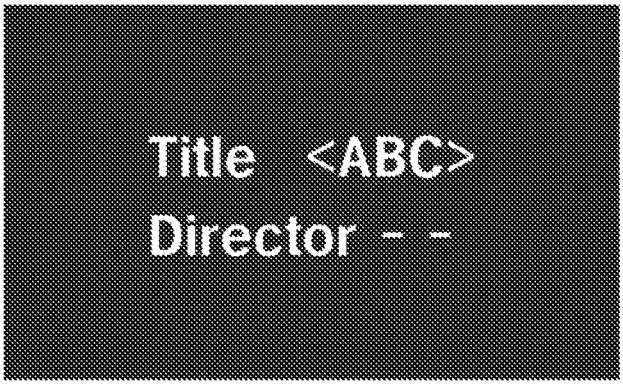
FIG. 11 is a diagram illustrating brightness information according to another embodiment.
Figure 11:
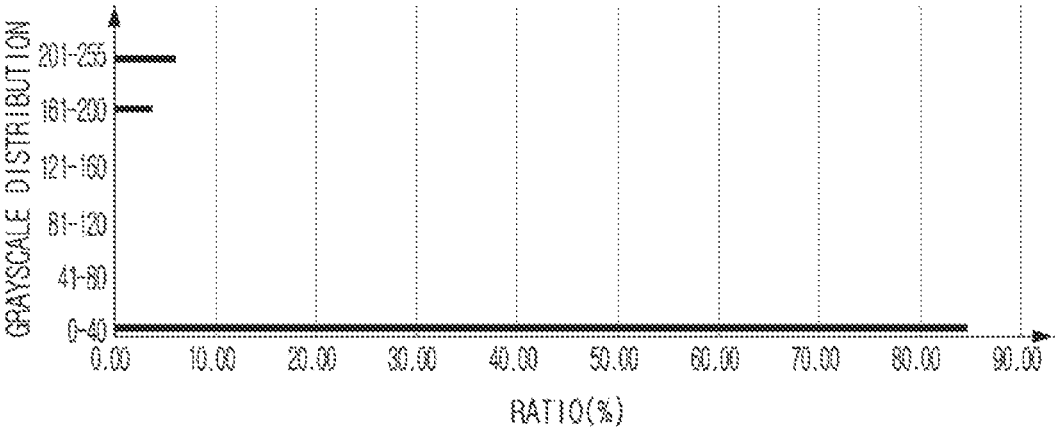

FIG. 11 is a diagram illustrating brightness information according to another embodiment.

Referring to FIG. 11, the processor 150 may identify whether the brightness information is less than a threshold value by applying different weights to each of the grayscale histogram and the APL of the first bit image.

For example, if the APL of the first bit image is less than the threshold value when the grayscale greater than or equal to the specific grayscale value is not 0%, based on the grayscale histogram of the first bit image, the processor 150 may identify that the brightness information of the first bit image is less than the threshold value.

As another example, the processor 150 may identify whether the brightness information of the first bit image is less than a threshold value by assigning different weights to each of an average picture level of the first bit image and a grayscale ratio (%) less than a specific grayscale value based on a grayscale histogram of the first bit image. For example, if the average picture level of the first bit image is less than 10%, the processor 150 may identify whether the grayscale ratio (%) less than a specific grayscale value exceeds 50% based on the grayscale histogram of the first bit image. The specific numbers and ratios are exemplary only for convenience and are not limited thereto.

Figure 12:
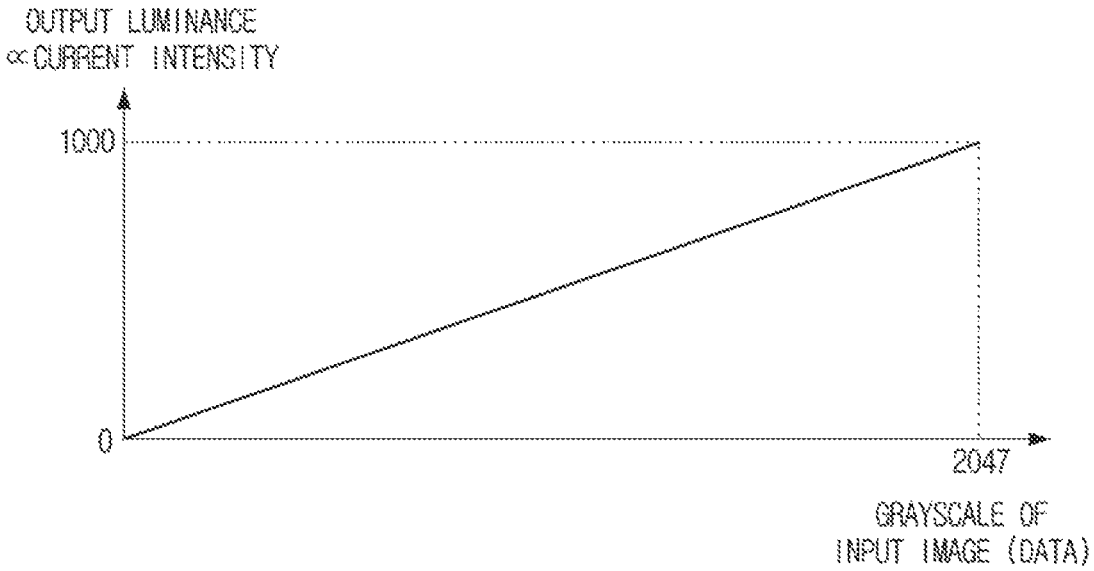
FIG. 12 is a diagram illustrating third output luminance information according to an embodiment.

FIG. 12 is a diagram illustrating third output luminance information according to an embodiment.

The electronic apparatus 100 may further include third output luminance information corresponding to a third bit image in addition to the first and second output luminance information.

For example, the third bit image may be an 11-bit image, and the third output luminance information may include output luminance corresponding to each of the 0 to 2047 grayscale levels. Here, the 11-bit image is merely an example and is not limited thereto.

For example, the first bit image may be a 10-bit image, and the first output luminance information may include output luminance information of each of 1024 grayscale levels (e.g., 0 to 1023 grayscale levels). The second bit image may be an 11-bit image, and the second output luminance information may include output luminance information of each 2048 grayscale levels (e.g., 0 to 2047 grayscale levels).

The third bit image may be an 8-bit image, and the third output luminance information may include output luminance information of each of 256 grayscale levels (e.g., 0 to 255 grayscale levels).

The processor 150 may drive a backlight block corresponding to pixels or regions having a grayscale value less than a first threshold grayscale based on third output luminance information if the brightness information of the first bit image is less than a threshold value. The processor 150 may drive a backlight block corresponding to pixels or regions having a grayscale value less than or equal to a first threshold grayscale and less than a second threshold grayscale based on the second output luminance information. The processor 150 may drive a backlight block corresponding to pixels or regions having a grayscale value greater than or equal to a second threshold grayscale based on the first output luminance information. The processor 150 may mix the first to third output luminance information to provide the first bit image.

For example, if the brightness information of the 8-bit image is less than the threshold value, the processor 150 may drive the backlight block corresponding to the pixel or region having the grayscale value less than the first threshold grayscale on the basis of the output luminance information corresponding to the 11-bit image. The processor 150 may drive a backlight block corresponding to a pixel or region having a grayscale value less than or equal to a first threshold grayscale and less than a second threshold grayscale on the basis of output luminance information corresponding to a 10-bit image. The processor 150 may drive a backlight block corresponding to a pixel or region having a grayscale value greater than or equal to a second threshold grayscale on the basis of output luminance information corresponding to an 8-bit image.

As the processor 150 reduces the change amount of the output luminance between the pixels and regions having a somewhat dark grayscale value, and maintains the change amount of the output luminance between the pixels and regions having a somewhat bright grayscale value, the user may not feel that the brightness of the image is distorted.

The configuration that the processor 150 may drive the backlight 130 by using first to third output luminance information is merely one example and is not limited thereto. For example, the processor 150 may drive the backlight 130 using first to fourth output luminance information. The fourth output luminance information may be output luminance information corresponding to the fourth bit image which is different from the first to third bit images.

Figure 13:
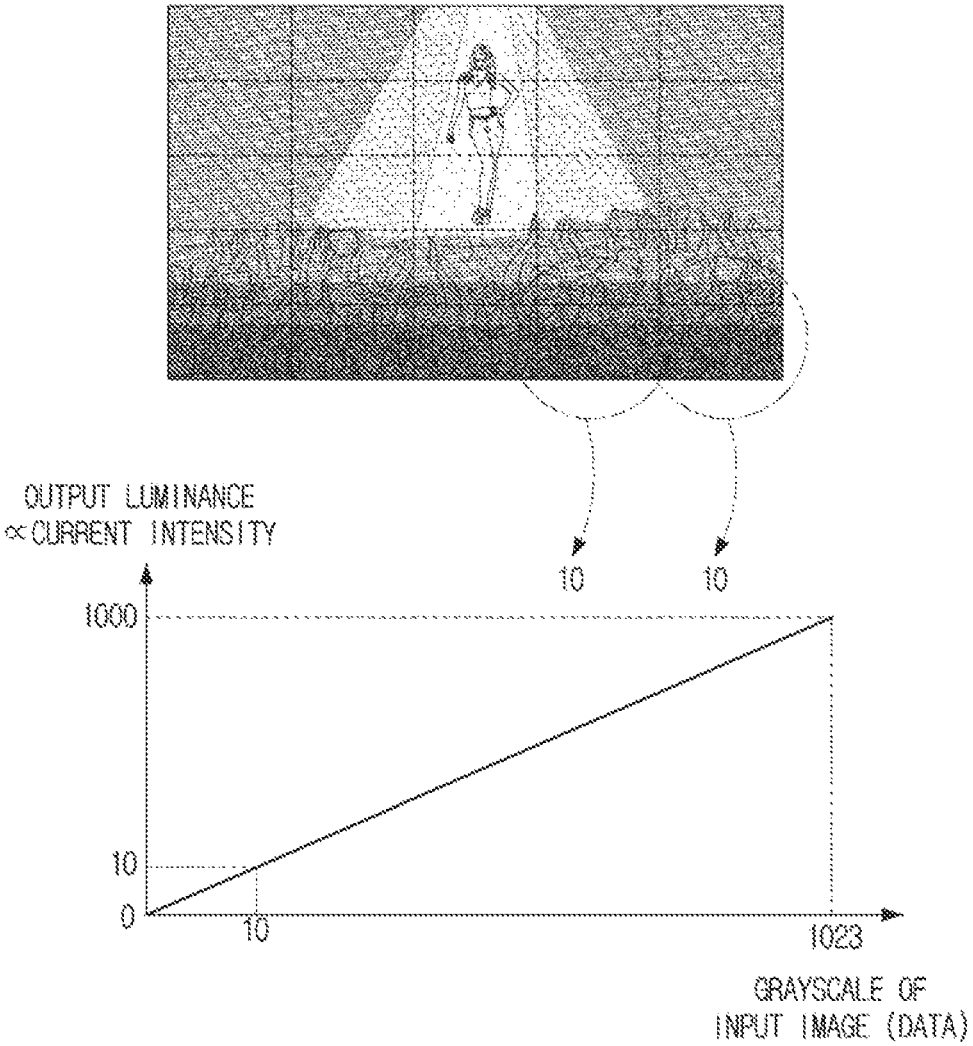
FIG. 13 is a diagram illustrating output luminance information corresponding to an image according to an embodiment.

FIG. 13 is a diagram illustrating output luminance information corresponding to an image according to an embodiment.

Referring to FIG. 13, the processor 150 according to an embodiment may identify a region corresponding to each of a plurality of backlight blocks in the first bit image if the brightness information of the first bit image is less than a threshold value. The processor 150 may then identify a backlight block corresponding to the pixels having a grayscale value less than the first threshold gray scale based on the average grayscale value of each of the identified regions.

For example, referring to FIGS. 3 and 4, the processor 150 may identify the average grayscale values of each of M×N regions, and may identify a region having a grayscale value less than the first threshold grayscale, among a plurality of average grayscale values. The processor 150 may identify the backlight block providing light to the identified region.

The processor 150 may drive the identified backlight block based on the second output luminance information.

The processor 150 may drive the backlight block adjacent to the identified backlight block based on the second output luminance information.

For example, since it is frequent that the gray scale value of the region adjacent to the region having the grayscale value less than the first threshold gray in the first bit image is less than the first threshold grayscale, the processor 150 may drive the backlight block adjacent to the identified backlight block based on the second output luminance information. Since the processor 150 may drive the specific backlight block and a backlight block adjacent to the specific backlight block based on the same output luminance information (e.g., the second output luminance information), the processor 150 may minimize the difference in output luminance between the regions and may reduce the amount of change in the output luminance between the regions.

Referring to FIG. 2, the memory 110 according to an embodiment may be electrically connected to the processor 150 and may store data for various embodiments. For example, the memory 110 may be implemented as an internal memory such as read-only memory (ROM) (e.g., electrically erasable programmable read-only memory (EEPROM)) and random access memory (RAM) included in the processor 150 or a memory separate from the processor 150.

The memory 110 may be implemented as a memory separate from the processor 150. The memory 110 may be implemented as a memory embedded in the electronic apparatus 100, and/or may be implemented as a detachable memory in the electronic apparatus 100, according to the purpose of data usage. For example, data for driving the electronic apparatus 100 may be stored in a memory embedded in the electronic apparatus 100, and data for an additional function of the electronic apparatus 100 may be stored in the memory detachable to the electronic apparatus 100. A memory embedded in the electronic apparatus 100 may be at least one of a volatile memory, such as a dynamic random access memory (DRAM), a static random access memory (SRAM), a synchronous dynamic random access memory (SDRAM), or a nonvolatile memory, such as one-time programmable ROM (OTPROM), programmable ROM (PROM), erasable and programmable ROM (EPROM), EEPROM, mask ROM, flash ROM, a flash memory (e.g., NAND flash or NOR flash), a hard disk drive or a solid state drive (SSD).

In the case of a memory detachably mounted to the electronic apparatus 100, the memory may be implemented as a memory card (e.g., a compact flash (CF), secure digital (SD), micro secure digital (micro-SD), mini secure digital (mini-SD), extreme digital (xD), multi-media card (MMC), and etc.), an external memory (e.g., a USB memory) connectable to the USB port, or the like.

An input interface may receive various types of contents. For example, the input interface may receive an image signal by streaming or downloading from an external device, an external storage medium (e.g., a universal serial bus (USB) memory), an external server (e.g., a web hard, etc.) through communication methods such as, for example, and without limitation, an access point (AP)-based Wi-Fi (e.g., a wireless local area network (WLAN)), Bluetooth, Zigbee, wired/wireless LAN, wide area network (WAN), Ethernet, IEEE 1394, high definition multimedia interface (HDMI), universal serial bus (USB), mobile high-definition link (MHL), advanced encryption standard (AES)/European broadcasting union (EBU), optical, coaxial, or the like. The image signal may be a digital image signal of one of standard definition (SD), high definition (HD), full HD, or ultra HD, but is not limited thereto.

An output interface may output a sound signal. For example, the output interface may convert the digital sound signal processed by the processor 150 into an analog sound signal, amplify and output the analog sound signal. For example, the output interface may include, without limitation, at least one speaker unit, a D/A converter, an audio amplifier, or the like, configured to output at least one channel. According to an example, the output interface may be implemented to output various multi-channel sound signals. The processor 150 may control the output interface to process the input sound signal in accordance with the enhanced processing of the input image. For example, the processor 150 may convert an input two-channel sound signal into a virtual multi-channel (e.g., a 5.1 channel) sound signal, recognize a position where the display device 100' is located to process the signal as a cubic sound signal optimized to a space, or provide an optimized sound signal according to the type of input image (e.g., a content genre).

A user interface may be implemented as a device such as, for example, and without limitation, a button, a touch pad, a mouse, and a keyboard, or a touch screen, a remote control transceiver configured to perform the above-described display function and operation input function, or the like. The remote control transceiver may receive a remote control signal from an external remote controller through at least one communication method such as an infrared ray communication, Bluetooth communication, or Wi-Fi communication, or transmit the remote control signal.

The electronic apparatus 100 may further include a tuner and a demodulator according to an embodiment. A tuner may tune all pre-stored channels or channels selected by a user among radio frequency (RF) broadcast signals received through an antenna to receive an RF broadcast signal. The demodulator may receive and demodulate the digital IF (DIF) signal converted by the tuner, and may perform channel decoding, or the like. According to an embodiment, the input image received through the tuner may be processed through a demodulator, and then may be provided to the processor 150 for image processing according to an embodiment.

Figure 14:
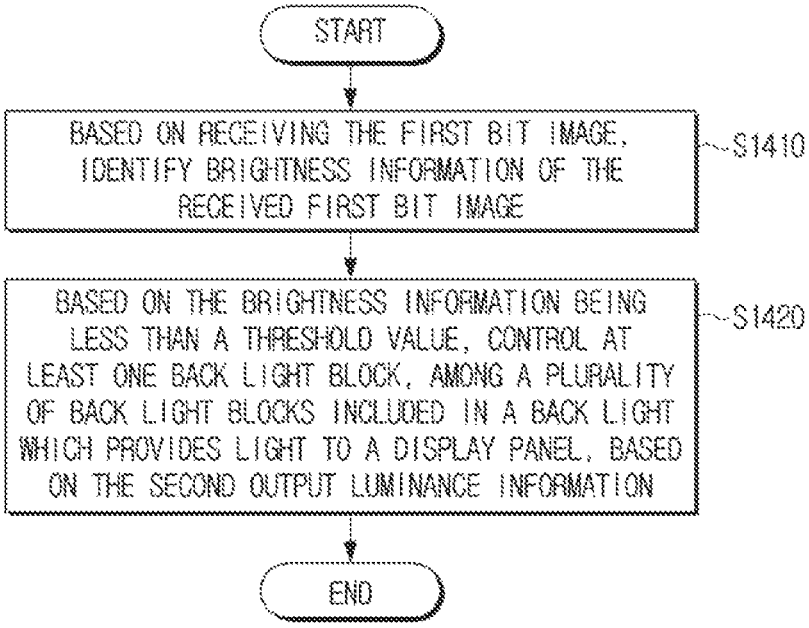
FIG. 14 is a flowchart illustrating a control method of an electronic apparatus according to an embodiment.

FIG. 14 is a flowchart illustrating a control method of an electronic apparatus according to an embodiment.

According to an embodiment, a control method of an electronic apparatus comprising first output luminance information corresponding to a first bit image and second output luminance information corresponding to a second bit image may include, based on receiving the first bit image, identifying brightness information of the received first bit image in operation S1410.

Based on the brightness information being less than a threshold value, the method may include controlling at least one backlight block, among a plurality of backlight blocks included in a backlight which provides light to a display panel, based on the second output luminance information in operation S1420.

The second bit image may be an image having a higher number of bits than the first bit image.

The first output luminance information according to an embodiment may include luminance information for each grayscale of the first bit image, and the second output luminance information may include luminance information for each grayscale of the second bit image.

In operation S1420, the controlling may include, based on the brightness information being less than a threshold value, driving a backlight block corresponding to pixels having a grayscale value less than a first threshold grayscale, among a plurality of pixels included in the first bit image, based on the second output luminance information.

In operation S1420, the controlling may include driving a backlight block corresponding to pixels having a grayscale value greater than or equal to the first threshold grayscale, among a plurality of pixels included in the first bit image, based on the first output luminance information.

According to an embodiment, an electronic apparatus may further include third output luminance information corresponding to a third bit image, and in the operation S1420, the controlling may include, based on the brightness information being less than a threshold value, driving a backlight block corresponding to pixels having a grayscale value that is greater than or equal to the first threshold grayscale and less than a second threshold grayscale based on the first output luminance information and driving a backlight block corresponding to pixels having a grayscale value greater than or equal to the second threshold grayscale based on the third output luminance information. The third bit image may be an image having a lower number of bits than the first bit image.

In operation S1420, the controlling may include identifying the first bit image as a region corresponding to each of the plurality of backlight blocks, and based on an average grayscale value of each of the identified regions, identifying a backlight block corresponding to pixels having a grayscale value less than the first threshold grayscale and driving the identified backlight block based on the second output luminance information.

In operation S1420, the controlling may include driving at least one backlight block adjacent to the identified backlight block based on the second output luminance information.

In operation S1410, the identifying may include obtaining the brightness information based on at least one of an average picture level (APL) of the first bit image or a grayscale histogram of the first bit image.

In operation S1410, the identifying may include identifying whether the brightness information is less than the threshold value by applying different weights to each of the APL and the grayscale histogram of the first bit image.

The first bit image may be a 10-bit image, the first output luminance information may include output luminance information of each of 1024 grayscale levels, the second bit image may be an 11-bit image, and the second output luminance information may include output luminance information of each of 2048 grayscale levels.

Various embodiments of the disclosure may be applicable not only to an electronic apparatus but also all electronic apparatuses configured to process images, such as an image receiving device (e.g., a set-top box), an image processing device, or the like.

The various embodiments described above may be implemented by instructions stored on a non-transitory computer-readable medium and executed by a computer or a device similar to a computer using software, hardware, or the combination of software and hardware. In some cases, embodiments described herein may be implemented by the processor 150 itself. According to a software implementation, embodiments such as the procedures and functions described herein may be implemented with separate software modules. Each of the software modules may perform one or more of the functions and operations described herein.

The computer instructions for performing processing operations in the electronic apparatus 100 according to the various embodiments described above may be stored in a non-transitory computer-readable medium. The computer instructions stored in this non-transitory computer-readable medium may cause a specific device to perform the processing operations in the electronic apparatus 100 according to the above-described various embodiments when executed by the processor of the specific device.

The non-transitory computer-readable medium may refer to a medium that semi-permanently stores data and is readable by a machine. Specific examples of the non-transitory computer-readable medium may include a CD, a DVD, a hard disk drive, a Blu-ray disc, a USB, a memory card, and a ROM.

While embodiments of the disclosure have been shown and described, the disclosure is not limited to the aforementioned specific embodiments, and it is apparent that various modifications can be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. An electronic apparatus comprising:

a memory configured to store first output luminance information corresponding to a first bit image, and second output luminance information corresponding to a second bit image;

a display panel;

a backlight including a plurality of backlight blocks configured to provide light to the display panel;

a driver configured to individually drive each backlight block of the plurality of backlight blocks; and a processor configured to:

based on the first bit image, identify brightness information of the first bit image, and based on the brightness information being less than a threshold value, control the driver to drive at least one backlight block, from among the plurality of backlight blocks, based on the second output luminance information, wherein the first output luminance information comprises first luminance information for each grayscale of the first bit image, wherein the second output luminance information comprises second luminance information for each grayscale of the second bit image, and wherein the processor is further configured to, based on the brightness information being less than the threshold value, control the driver to drive a first backlight block corresponding to pixels having a grayscale value less than a first threshold grayscale, from among a plurality of pixels included in the first bit image, based on the second output luminance information, identify a plurality of regions of the first bit image corresponding to the plurality of backlight blocks, and based on an average grayscale value of each of the plurality of regions, identify the first backlight block corresponding to pixels having a grayscale value less than the first threshold grayscale, and control the driver to drive the first backlight block based on the second output luminance information, wherein a number of bits of the second bit image is greater than a number of bits of the first bit image.

2. The electronic apparatus of claim 1, wherein the processor is further configured to control the driver to drive a second backlight block, from among the plurality of backlight blocks, corresponding to pixels having a grayscale value greater than or equal to the first threshold grayscale, from among the plurality of pixels included in the first bit image, based on the first output luminance information.

3. The electronic apparatus of claim 1, wherein the memory is further configured to store third output luminance information corresponding to a third bit image, wherein the processor is further configured to, based on the brightness information being less than the threshold value, control the driver to drive a second backlight block, from among the plurality of backlight blocks, corresponding to pixels having a grayscale value that is greater than or equal to the first threshold grayscale and less than a second threshold grayscale based on the first output luminance information, and control the driver to drive a third backlight block corresponding to pixels having a grayscale value greater than or equal to the second threshold grayscale based on the third output luminance information, and wherein a number of bits of the third bit image is less than the number of bits of the first bit image.

4. The electronic apparatus of claim 1, wherein the processor is further configured to control the driver to drive at least a second backlight block adjacent to the first backlight block based on the second output luminance information.

5. The electronic apparatus of claim 1, wherein the processor is further configured to obtain the brightness information based on at least one of an average picture level (APL) of the first bit image, or a grayscale histogram of the first bit image.

6. The electronic apparatus of claim 5, wherein the processor is further configured to identify whether the brightness information is less than the threshold value by applying different weights to the APL and the grayscale histogram of the first bit image.

7. The electronic apparatus of claim 1, wherein:

the first bit image is a 10-bit image, the first output luminance information corresponds to 1024 grayscale levels, the second bit image is an 11-bit image, and the second output luminance information corresponds to 2048 grayscale levels.

8. A method of controlling an electronic apparatus storing first output luminance information corresponding to a first bit image and second output luminance information corresponding to a second bit image, the method comprising:

based on the first bit image, identifying brightness information of the first bit image; and based on the brightness information being less than a threshold value, controlling at least one backlight block, from among a plurality of backlight blocks included in a backlight configured to provide light to a display panel, based on the second output luminance information, wherein the first output luminance information comprises first luminance information for each grayscale of the first bit image, wherein the second output luminance information comprises second luminance information for each grayscale of the second bit image, and wherein the controlling comprises, based on the brightness information being less than the threshold value, driving a first backlight block corresponding to pixels having a grayscale value less than a first threshold grayscale, from among a plurality of pixels included in the first bit image, based on the second output luminance information, identifying a plurality of regions of the first bit image corresponding to the plurality of backlight blocks;

based on an average grayscale value of each of the plurality of regions, identifying a first backlight block corresponding to pixels having a grayscale value less than a first threshold grayscale; and driving the first backlight block based on the second output luminance information, wherein a number of bits of the second bit image is greater than a number of bits of the first bit image.

9. The method of claim 8, wherein the controlling comprises driving a second backlight block, from among the plurality of backlight blocks, corresponding to pixels having a grayscale value greater than or equal to the first threshold grayscale, from among the plurality of pixels included in the first bit image, based on the first output luminance information.

10. The method of claim 8, wherein the electronic apparatus further stores third output luminance information corresponding to a third bit image, wherein the controlling comprises:

based on the brightness information being less than the threshold value, driving a second backlight block, from among the plurality of backlight blocks, corresponding to pixels having a grayscale value that is greater than or equal to the first threshold grayscale and less than a second threshold grayscale based on the first output luminance information; and driving a third backlight block corresponding to pixels having a grayscale value greater than or equal to the second threshold grayscale based on the third output luminance information, and wherein a number of bits of the third bit image is less that the number of bits of the first bit image.

11. The method of claim 8, wherein the controlling comprises driving at least a second backlight block adjacent to the first backlight block based on the second output luminance information.

12. The method of claim 8, wherein the identifying comprises obtaining the brightness information based on at least one of an average picture level (APL) of the first bit image, or a grayscale histogram of the first bit image.

13. The method of claim 12, wherein the identifying comprises identifying whether the brightness information is less than the threshold value by applying different weights to the APL and the grayscale histogram of the first bit image.

14. The method of claim 8, wherein:

the first bit image is a 10-bit image, the first output luminance information corresponds to 1024 grayscale levels, the second bit image is an 11-bit image, and the second output luminance information corresponds to 2048 grayscale levels.

15. A non-transitory computer-readable medium storing one or more instructions that, when executed by one or more processors of an electronic apparatus storing first output luminance information corresponding to a first bit image and second output luminance information corresponding to a second bit image, cause the one or more processors to:

based on the first bit image, identify brightness information of the first bit image; and based on the brightness information being less than a threshold value, controlling at least one backlight block, from among a plurality of backlight blocks included in a backlight configured to provide light to a display panel, based the second output luminance information, wherein the first output luminance information comprises first luminance information for each grayscale of the first bit image, wherein the second output luminance information comprises second luminance information for each grayscale of the second bit image, and wherein the controlling comprises, based on the brightness information being less than the threshold value, driving a first backlight block corresponding to pixels having a grayscale value less than a first threshold grayscale, from among a plurality of pixels included in the first bit image, based on the second output luminance information, identifying a plurality of regions of the first bit image corresponding to the plurality of backlight blocks;

based on an average grayscale value of each of the plurality of regions, identifying a first backlight block corresponding to pixels having a grayscale value less than a first threshold grayscale; and driving the first backlight block based on the second output luminance information, wherein a number of bits of the second bit image is greater than a number of bits of the first bit image.

* * * * *